US005620059A

United States Patent [19]

Crispeno

[11] Patent Number: 5,620,059

[45] Date of Patent: Apr. 15, 1997

[54] VEHICLE BUMPER PROTECTOR FOR GOLF SPIKES

[76] Inventor: Carmen C. Crispeno, 110 Tenth St., Conway, Pa. 15027

[21] Appl. No.: 287,858

[22] Filed: Aug. 9, 1994

[51] Int. Cl.[6] ..... E06C 5/00

[52] U.S. Cl. ..... 182/127; 182/92; 182/206

[58] Field of Search ..... 182/127, 92, 206, 182/150; 248/214; 403/381

[56] References Cited

U.S. PATENT DOCUMENTS

| | | | |
|---|---|---|---|
| 953,461 | 3/1910 | Entwistle . | |
| 957,324 | 5/1910 | Gall . | |
| 1,426,787 | 8/1922 | Spencer . | |
| 1,814,933 | 7/1931 | Keen | 403/381 |
| 1,919,780 | 7/1933 | Fairbank | 52/584 |
| 2,378,678 | 6/1945 | Anderson | 228/51 |
| 2,614,471 | 10/1952 | Markowitz | 248/214 X |
| 2,698,048 | 12/1954 | Schweizer | 155/78 |
| 2,751,967 | 6/1956 | Sitterley | 155/79 |
| 2,781,081 | 2/1957 | Hynes | 155/78 |
| 2,920,853 | 1/1960 | Bufogle | 248/214 |
| 3,289,611 | 12/1966 | Flanders | 108/44 |
| 3,404,751 | 10/1968 | Nosworthy | 182/92 X |
| 3,706,105 | 12/1972 | Nicholas et al. | 5/93 R |
| 4,138,019 | 2/1979 | Smith | 248/214 X |
| 4,605,098 | 8/1986 | Leuty | 182/92 |
| 4,782,916 | 11/1988 | Hays | 182/92 X |
| 4,785,910 | 11/1988 | Tonkovich | 182/92 |
| 4,799,609 | 1/1989 | Castilla | 224/42.07 |
| 4,850,282 | 7/1989 | Postic | 108/47 |
| 4,907,767 | 3/1990 | Miller | 182/150 |
| 4,911,264 | 3/1990 | McCafferty | 182/92 |
| 4,984,722 | 1/1991 | Moore | 224/42.43 |
| 5,106,046 | 4/1992 | Rowles et al. | 248/311.2 |
| 5,197,381 | 3/1993 | Mells | 108/44 |

*Primary Examiner*—Alvin C. Chin-Shue

*Attorney, Agent, or Firm*—Webb Ziesenheim Bruening Logsdon Orkin & Hanson, P.C.

[57] ABSTRACT

A vehicle bumper protector for golf spikes is disclosed and includes an inverted U-shaped trunk support bracket formed from a pair of right angle L-shaped members. A footrest is connected, preferably through a vertical back plate, to the trunk support bracket. Both the vertical height of the footrest on the trunk support bracket and the width between vertical legs of the trunk support bracket are adjustable. When installed on a vehicle, the trunk support bracket securely straddles a rear wall of a vehicle trunk and the footrest securely rests on a vehicle bumper. The device can be easily adjusted for use on other vehicles.

4 Claims, 7 Drawing Sheets

VEHICLE BUMPER PROTECTOR FOR GOLF SPIKES

BACKGROUND OF THE INVENTION

1. Field of the Invention

This invention relates to vehicle bumper protectors and, more particularly, to such protectors which will prevent scratching of or damage to a vehicle bumper from golf spikes.

2. Background Art

The game of golf has become increasingly popular in the United States today. While a modern golfer utilizes much equipment for the sport, most golfers wear golf shoes which have a plurality of thin, metal spikes on the sole. Golfers often drive to a golf course fully clothed for a round of golf, with the exception of golf spikes. A golfer will typically change from street shoes to golf spikes in the parking lot of a golf course, most often at the golfer's vehicle. In order to change into golf spikes, a golfer may sit on the vehicle seat with the door open, placing the golf spikes on the ground and bending over to insert a foot into a shoe and tie the shoelaces. This is often quite uncomfortable for older golfers or for those golfers with bad backs. A golfer may also stand erect and lift one foot at a time up into the air to put on the golf spikes. However, this method is quite awkward for most golfers. Placing the golf spikes on a raised footrest is a more acceptable method, but in a parking lot the only raised areas are often portions of a vehicle and it is highly undesirable to place sharp golf spikes on most or all areas of typical vehicles.

A wide variety of steps, supports and the like have been developed in the past for use with vehicles. Different devices are shown in U.S. Pat. Nos. 2,378,678; 2,698,048; 2,781,081; 3,289,611; 4,785,910; 4,799,609; 4,907,674; 4,911,264 and 5,197,381. However, none of these devices is particularly suited for use with golf spikes. In addition, many of these devices are complicated and difficult or cumbersome to use or are intended to be more permanently attached to a vehicle.

It is, therefore, an object of the present invention to provide a vehicle mounted device which protects the bumper of a vehicle and allows a golfer to place golf spikes on the vehicle bumper. It is a further object to provide such a vehicle bumper protector in an arrangement which is easy to use, which is moveable to another vehicle and which is inexpensive to manufacture.

SUMMARY OF THE INVENTION

Accordingly, I have developed a vehicle bumper protector for golf spikes which includes an inverted U-shaped trunk support bracket which has spaced and parallel inner and outer vertical legs extending downward from and attached to a horizontal brace. The vehicle bumper protector also includes a footrest connected to an outer surface of the outer vertical leg of the trunk support bracket and extending outwardly therefrom. A first adjustment means is provided for adjusting the vertical position of the footrest along the trunk support bracket. A second adjustment means is provided for adjusting the width of the trunk support bracket between the inner and outer vertical legs. The width between the vertical legs of the trunk support bracket is adjusted to allow the bracket to straddle a rear wall of the vehicle trunk and the vertical position of the footrest along the trunk support bracket is adjusted to allow a lower surface of the footrest to contact an upper surface of a vehicle bumper when the horizontal brace of the trunk support bracket contacts an upper surface of the rear wall of a vehicle trunk.

The trunk support bracket preferably includes a pair of right angle L-shaped members connected to each other, with a horizontal leg of a first of the L-shaped members abutting, and preferably located above, and connected to a horizontal leg of a second of the L-shaped members. The horizontal legs form the horizontal brace of the trunk support bracket, a vertical leg of the first L-shaped member forms the outer vertical leg of the trunk support bracket and a vertical leg of the second L-shaped member forms the inner vertical leg of the trunk support bracket. In a preferred embodiment, the footrest is connected to an outer surface of a vertical back plate which has an inner surface which abuts and is connected to an outer surface of the vertical leg of the first L-shaped member.

The back plate can include an elongated first adjustment slot therethrough and extending substantially vertically therealong. A first releasable fastening means, such as a wing nut fastener, passes through the vertical leg of the first L-shaped member and through the first adjustment slot. The first releasable fastening means both connects the back plate to the vertical leg of the first L-shaped member and, along with the first adjustment slot, forms the first adjustment means. In addition, one of the horizontal legs of the L-shaped members, preferably the horizontal leg of the first L-shaped member, includes an elongated second adjustment slot therethrough and extending substantially horizontal and perpendicular to the first adjustment slot. A second releasable fastening means, such as another wing nut fastener, passes through the other of the horizontal legs of the L-shaped member and through the second adjustment slot. The second releasable fastening means connects the horizontal legs of the L-shaped members and, along with the second adjustment slot, forms the second adjustment means.

In order to prevent twisting of the adjustable members as they are moved, guide ridges and corresponding guide grooves can be provided between the moving elements. In particular, a first raised guide ridge spaced from and extending parallel to the first adjustment slot is located on one of the outer surface of the vertical leg of the first L-shaped member and an inner surface of the back plate, along with an elongated first guide groove complementary to the first guide ridge, extending parallel to the first adjustment slot and located in the other of the outer surface of the vertical leg of the first L-shaped member and the inner surface of the back plate. Preferably, the first raised guide ridge is provided on the vertical leg of the first L-shaped member and the first guide groove is provided in the back plate. The first guide ridge fits in and is slideable along the first guide groove when the back plate is connected to the vertical leg of the first L-shaped member. Similarly, a second raised guide ridge extending parallel to the second adjustment slot is located on one of the inner surface of the horizontal leg of the first L-shaped member and an outer surface of the horizontal leg of the second L-shaped member. An elongated second guide groove complementary to the second guide ridge extends parallel to the second adjustment slot and is located in the other of the inner surface of the horizontal leg of the first L-shaped member and the outer surface of the horizontal leg of the second L-shaped member. It is preferred that the second raised guide ridge be positioned on the outer surface of the horizontal leg of the second L-shaped member, with the second guide groove located on the inner surface of the horizontal leg of the first L-shaped member. The second guide ridge fits in and is slideable along the second guide groove when the L-shaped members are connected together.

It is preferred that all of the elements of the present invention, including the footrest, back plate, L-shaped members and fasteners, be formed of a plastic material. In addition, it is preferred that the footrest slope downward slightly as it extends outwardly from the back plate.

DESCRIPTION OF THE PREFERRED EMBODIMENTS

Figure 1:
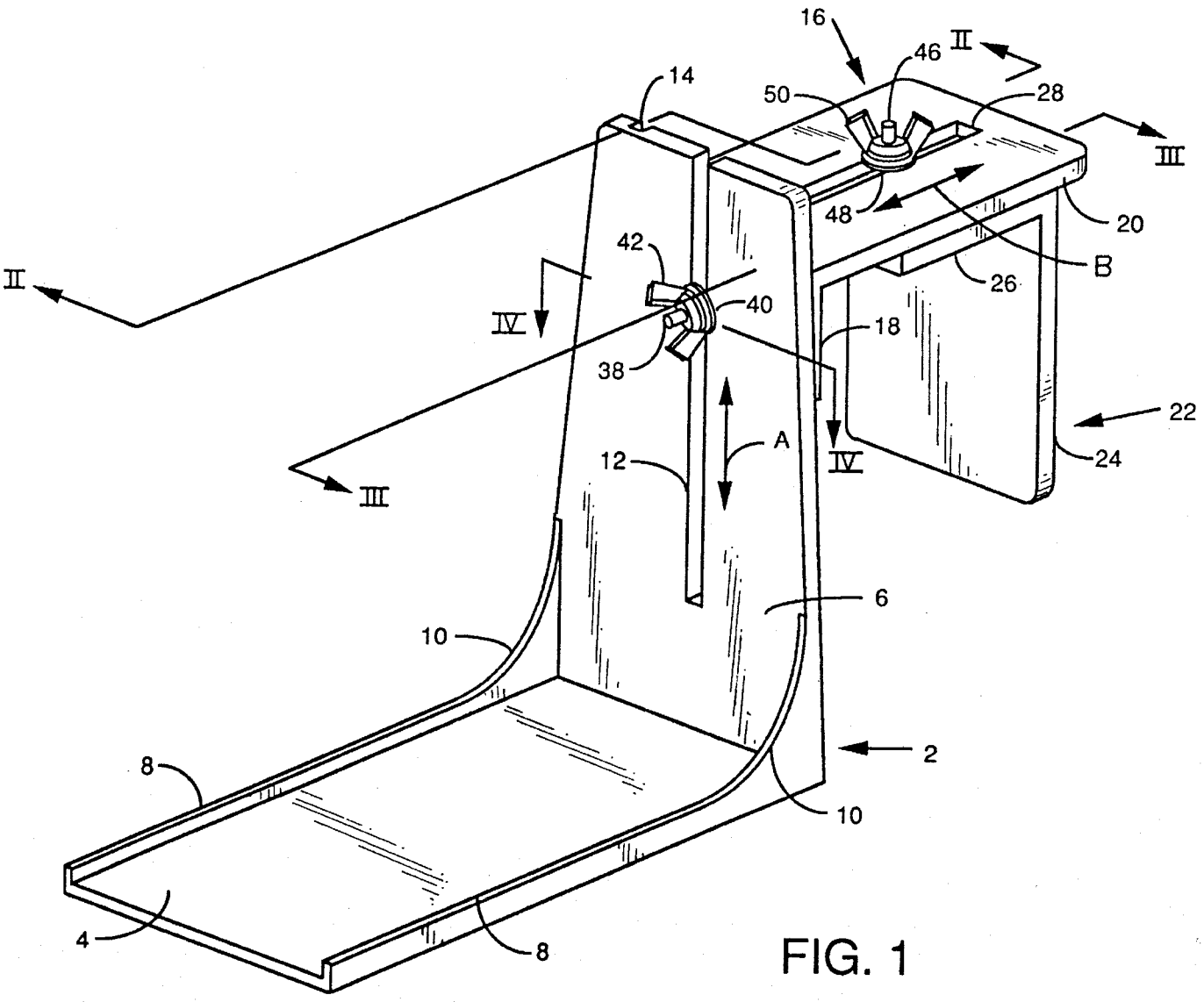
FIG. 1 is a perspective view of one embodiment of a vehicle bumper protector in accordance with the present invention.

One embodiment of a vehicle bumper protector for golf spikes in accordance with the present invention is shown in FIGS. 1–5. The bumper protector includes a substantially L-shaped base member 2 including a planar, preferably rectangular, horizontal footrest 4 extending outwardly from and attached to a lower edge of a planar vertical back plate 6. Raised side rails 8 can be provided on an upper surface of the footrest 4 along its outer side edges. The side rails 8 can extend into wider corner braces 10 where the footrest 4 is attached to the back plate 6. An elongated, substantially vertical, first adjustment slot 12 is provided through the back plate 6, from its outer to its inner surfaces, and extends from an upper edge toward, but stops short of, the lower edge of the back plate 6 where the back plate 6 and the footrest 4 are connected. A recessed first guide groove 14 is located in an inner surface of the back plate 6, spaced from and substantially parallel to the first adjustment slot 12, and extends from the upper edge of the back plate 6 toward, but preferably stops short of, the lower edge of the back plate 6. The back plate 6 is preferably trapezoidal in shape, and gradually widens from a narrower upper edge to a lower edge having the same width as the footrest 4. The footrest 4 preferably slopes downward as it extends outwardly from the back plate 6, such as at an angle of about 100°.

The vehicle bumper protector also includes an inverted U-shaped trunk support bracket formed from a pair of right angle L-shaped members connected to each other. The U-shaped bracket includes a first L-shaped member 16, also referred to as a top brace, which includes vertical leg 18 attached to horizontal leg 20. A second L-shaped member 22, also referred to as an inside trunk clamp, includes vertical leg 24 and horizontal leg 26. The vertical leg 18 of the first L-shaped member 16 forms an outer vertical leg of the trunk support bracket and vertical leg 24 of the second L-shaped member 22 forms an inner vertical leg of the trunk support bracket. The vertical legs of the trunk support bracket are spaced apart from and parallel to each other. The horizontal legs 20 and 26 abut one another when the first L-shaped member 16 is connected to the second L-shaped member 22 to form the trunk support bracket. Vertical leg 18 and horizontal leg 20 of the first L-shaped member 16 and vertical leg 24 and horizontal leg 26 of the second L-shaped member 22 are each preferably planar, rectangularly shaped members. In a preferred embodiment, vertical leg 18 is substantially shorter than horizontal leg 20 on the first L-shaped member 16. Similarly, horizontal leg 26 is substantially shorter than vertical leg 24 on the second L-shaped member 22. In addition, it is preferred that the horizontal leg 20 of the first L-shaped member 16 be located above horizontal leg 26 of the second L-shaped member 22, with an inner or lower surface of horizontal leg 20 of the first L-shaped member 16 abutting and contacting an outer or upper surface of horizontal leg 26 of the second L-shaped member 22.

Horizontal leg 20 of the first L-shaped member 16 includes a second adjustment slot 28 extending therethrough along a portion of horizontal leg 20. It is preferred that the second adjustment slot 28 stop short of the edge of horizontal leg 20 where it abuts vertical leg 18 on the first L-shaped member 16 and, similarly, stop short of the edge opposite and spaced from vertical leg 18 of the first L-shaped member 16. The second adjustment slot 28 extends horizontal and perpendicular to the first adjustment slot 12 and is preferably aligned therewith. Similar to the back plate 6, the inner surface of horizontal leg 20 of the first L-shaped member 16 includes a recessed second guide groove 30 spaced from and extending substantially parallel to the second adjustment slot 28. The second guide groove 30 can extend from the outer edge of horizontal leg 20 opposite the connection to vertical leg 18 up to and even contacting vertical leg 18.

A first raised guide ridge 32 is provided on an outer surface of vertical leg 18 of the first L-shaped member 16 and is spaced from and extends parallel to the first adjustment slot 12. The first raised guide ridge 32 is complementary with the first guide groove 14 and fits within and is slideable along the first guide groove 14 when the elements of the vehicle bumper protector are assembled. Similarly, a second raised guide ridge 34 is provided on an upper surface of horizontal leg 26 of the second L-shaped member 22 and is spaced from and extends parallel to the second adjustment slot 28. The second raised guide ridge 34 is complementary with the second guide groove 30 and fits within and is slideable along the second guide groove 30 when the elements of the vehicle bumper protector are assembled. While the figures show the raised guide ridges 32 and 34 and guide grooves 14 and 30 in particular locations, the position of cooperating guide ridge/guide groove pairs can be reversed if desired. For example, the first guide groove 14 can be located on vertical leg 18 of the first L-shaped member 16 and the first raised guide ridge 32 can be located on the back plate 6.

Figure 2:
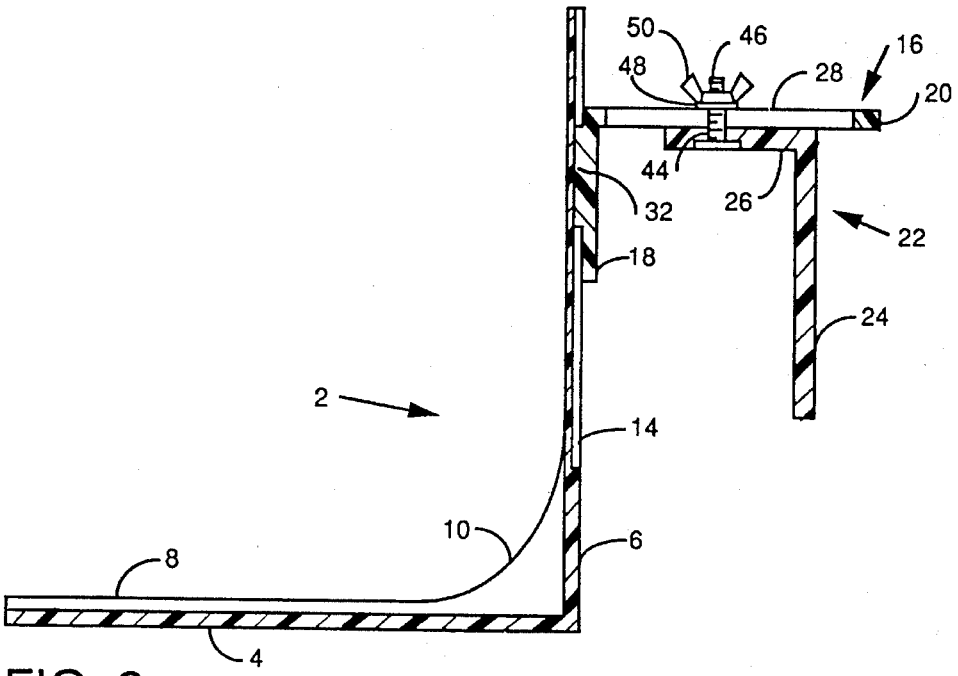
FIG. 2 is a section taken along lines II—II in FIG. 1.
Figure 4:
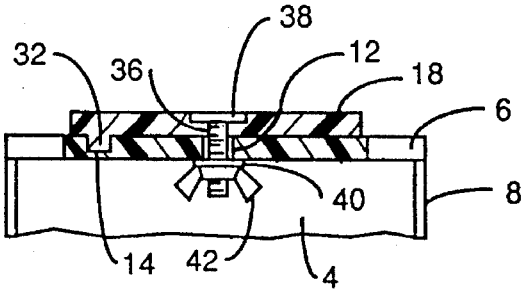
FIG. 4 is a section taken along lines IV—IV in FIG. 1.

Screw hole 36 is provided through vertical leg 18 of the first L-shaped member 16 and is aligned with the first adjustment slot 12 in the back plate 6. A releasable fastener, such as plastic screw 38, extends through screw hole 36 and through the first adjustment slot 12 and is secured in place by washer 40 and wing nut 42. Similarly, screw hole 44 is provided through horizontal leg 26 of the second L-shaped member 22 and plastic screw 46 extends through screw hole 44 and through the second adjustment slot 28 and is secured in place by washer 48 and wing nut 50. In this manner, the back plate 6 is attached to the first L-shaped member 16 by plastic screw 38, washer 40 and wing nut 42, while the second L-shaped member 22 is connected to the first L-shaped member by plastic screw 46, washer 48 and wing nut 50. Plastic screws 38 and 46 are preferably flat-headed and are recessed within and do not protrude above vertical leg 18 on the first L-shaped member 16 and horizontal leg 26 on the second L-shaped member as shown in FIGS. 4 and 2, respectively. This provides a smooth interior to the trunk support bracket.

Figure 5:
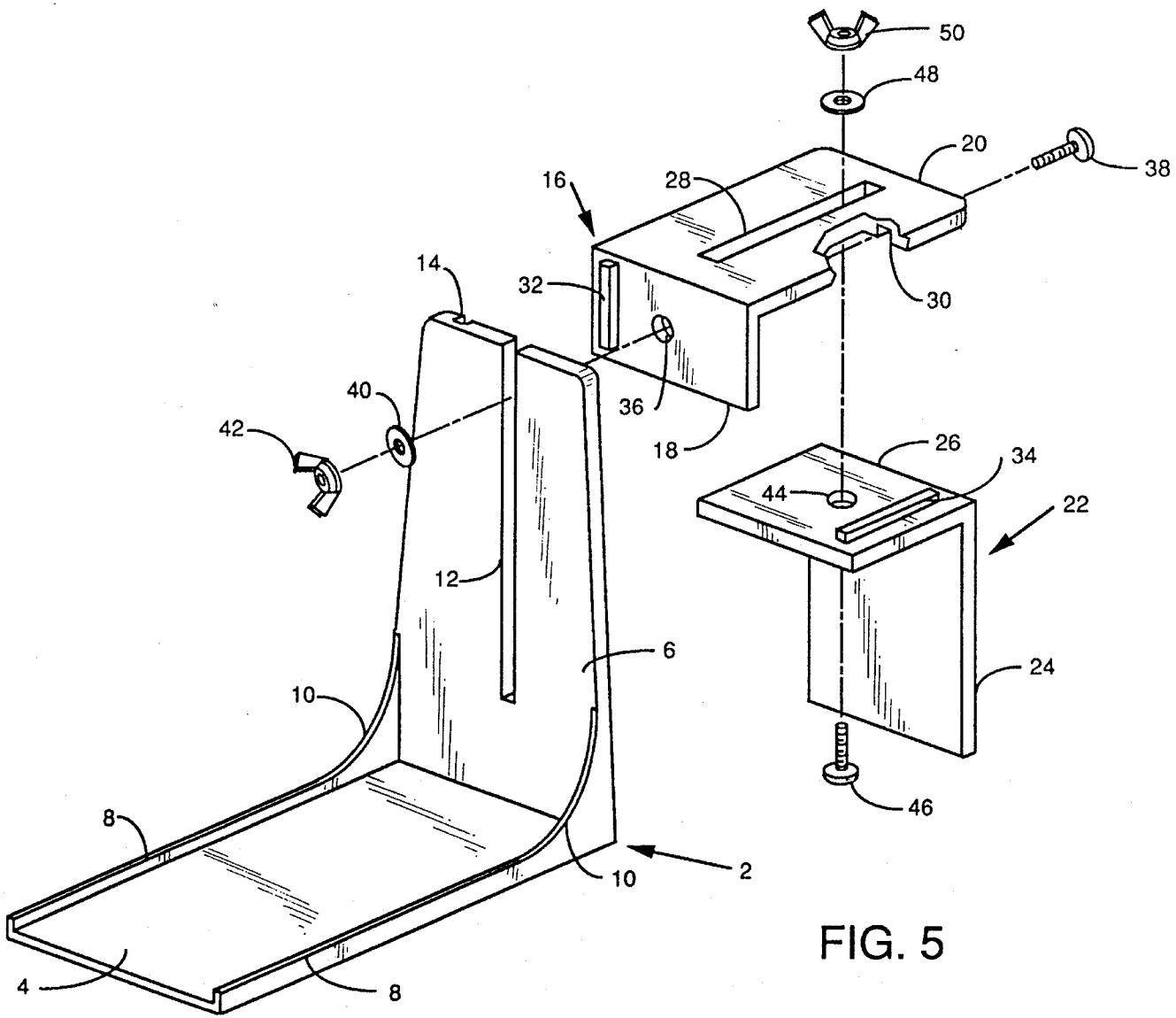
FIG. 5 is an exploded perspective view of the vehicle bumper protector shown in FIG. 1.

When the second L-shaped member 22 is connected to the first L-shaped member 16 as described above, the second raised guide ridge 34 fits within and can slide along the second guide groove 30. Similarly, when the first L-shaped member 16 is connected to the back plate 6, the first raised guide ridge 32 is positioned within and can slide along the first guide groove 14. It is preferred that the second adjustment slot 28 extend substantially perpendicular to and aligned with the first adjustment slot 12 when the elements of the vehicle bumper protector are assembled. In addition, it is preferred that the guide grooves be provided on opposite sides of their respective adjustment slots, i.e., as shown in FIG. 5, the first guide groove 14 is shown to the left side of the first adjustment slot 12 while the second guide groove 30 is shown on the right side of the second adjustment slot 28.

By affixing the second L-shaped member 22 to the first L-shaped member 16 as described above, an inverted U-shaped trunk support bracket is formed. The footrest 4 is attached to an outer surface of an outer leg of the trunk support bracket, i.e., vertical leg 18 of the first L-shaped member 16, by attaching the back plate 6 to the first L-shaped member 16 as described above. Through the use of the releasable wing nut fastener 38/40/42 and the first adjustment slot 12, the vertical position of the back plate 6 and, hence, the vertical position of the footrest 4, can be adjusted by moving the back plate 6 up and down along the first adjustment slot 12 and then locked in place. Similarly, the width of the trunk support bracket, i.e., the spacing between parallel vertical legs 18 and 24 of the first and second L-shaped members 16 and 22, respectively, can be adjusted by appropriately positioning the second L-shaped member 22 along the second adjustment slot 28. Releasable wing nut fastener 46/48/50 allows this adjusted width to be locked in place. The vertical adjustability of the footrest 4 along the U-shaped bracket is shown by a double headed arrow A in FIG. 1. Similarly, the adjustability of the width of the trunk support bracket is shown by the double headed arrow B in FIG. 1. The use of the raised guide ridge/guide groove combinations (32/12 and 34/28) in the two adjustment areas prevents the L-shaped members 16 and 22 from twisting radially about their respective wing nut fasteners during the sliding adjustment process.

Figure 6:
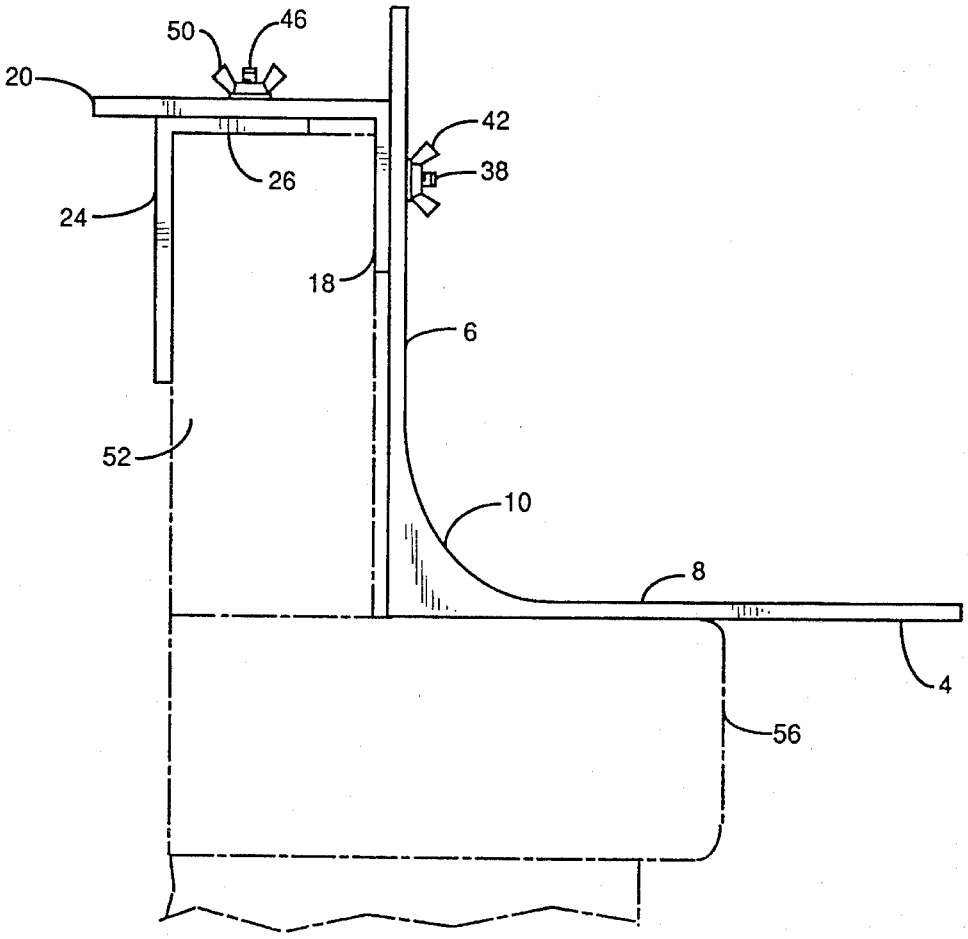
FIG. 6 is a side view of the vehicle bumper protector shown in FIG. 1 and installed on a vehicle trunk wall.
Figure 3:
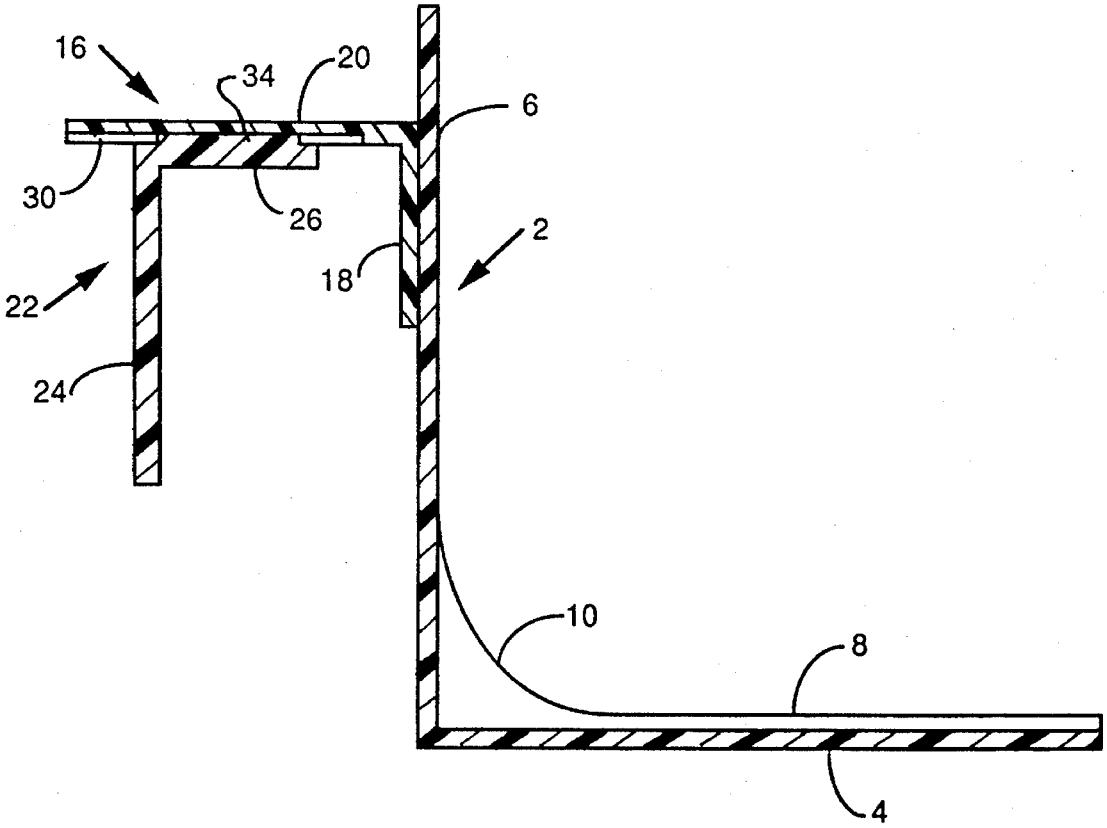
FIG. 3 is a section taken along lines III—III in FIG. 1.
Figure 7:
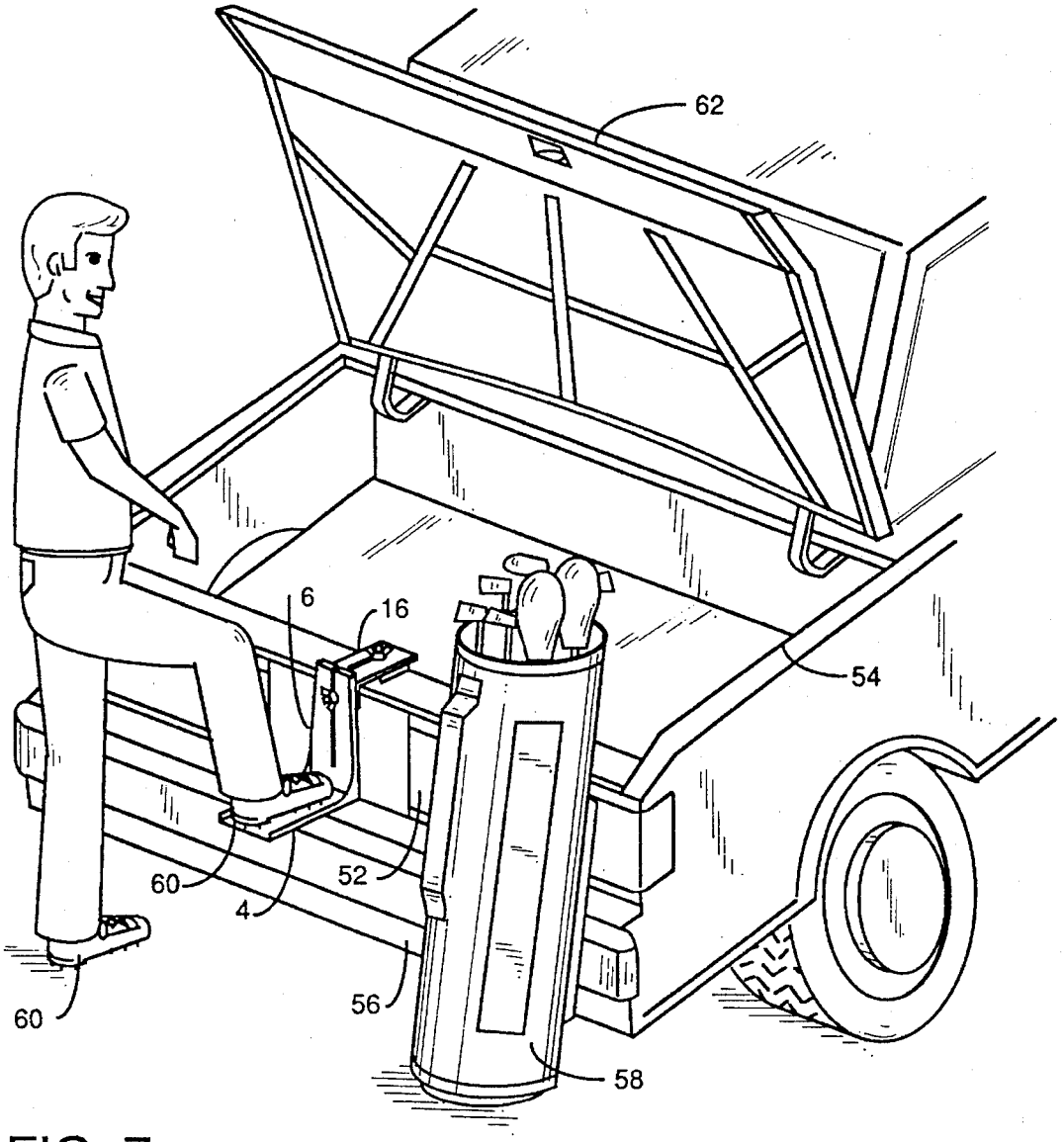
FIG. 7 is a perspective view of a golfer using the vehicle bumper protector shown in FIG. 1 and installed on a vehicle trunk wall.

The use of the present invention is shown in connection with FIGS. 6 and 7. The U-shaped support bracket is configured to straddle and hang upon a trunk wall 52 of an open vehicle trunk 54. The width of the support bracket is adjusted appropriately as described above so that the outer leg (vertical leg 18) contacts an outer surface of the trunk wall 52 and the inner leg (vertical leg 24) contacts the inner surface of the trunk wall 52. The vertical position of the footrest 4 along the trunk support bracket is adjusted so that the lower surface of the footrest 4 contacts the upper surface of a vehicle bumper 56 and the horizontal brace (horizontal legs 20 and 26) of the trunk support rests upon the upper surface of the trunk wall 52. It is preferred that the footrest 4 slope slightly downward and outward from the back plate 6 since most vehicle bumpers have a similar slope for water drainage.

The present invention is relatively easy to use. Firstly, a golfer would adjust the support bracket width and footrest height for a particular vehicle. Typically, the bumper protector will be stored in the vehicle trunk 54, along with a bag of golf clubs 58, golf spikes 60 and the like. When a golfer is in the parking lot of a golf course, the golfer will open up the trunk lid 62, remove the golf clubs 58 and golf spikes 60 from the trunk 54 as well as remove the bumper protector of the present invention from the trunk 54. Since the adjustments have been previously made and locked in place via the wing nut fasteners, a golfer need only position the vehicle bumper protector with the support bracket over the trunk wall as shown in FIGS. 6 and 7. The footrest 4 provides a convenient raised position for placing the golf spikes 60, yet protects the vehicle bumper 56 from scratching and the like due to the sharp spikes. Once the golfer has finished, the vehicle bumper protector is merely lifted up off of the trunk wall 52 and placed back into the trunk 54. The process is repeated when a golfer wishes to remove the golf spikes 60 after a round of golf.

The present invention can be made of many different materials, but it is believed that a strong, lightweight plastic material may be best. The base 2, including the footrest 4 and back plate 6, as well as the first and second L-shaped members 16 and 22 would be made of the same plastic material. The wing nut fasteners, including the plastic screws 38 and 46, washers 40 and 48 and wing nuts 42 and 50, could be made of plastic material and are readily available in the commercial market. It is expected that typical dimensions for the elements include: a 9" long by 5" wide footrest; 10" high back plate, tapering from a 3" top edge width to a 5" bottom edge width matching that of the footrest; a 3" long by 2½" wide vertical leg and a 5" long by 2½" wide horizontal leg on the first L-shaped member; a 2½" wide and 3" long horizontal leg and a 2 ½" wide by 4½" long vertical leg on the second L-shaped member; 3/32" wide guide ridges; 1/16" wide guide slots; and ¼" wide adjustment slots for a 3/16" flat head screw.

Figure 8:
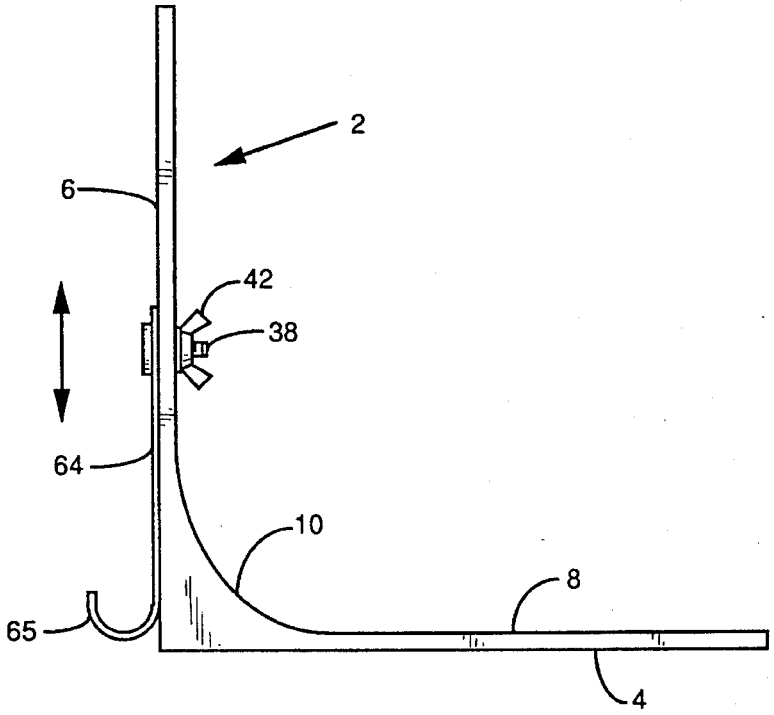
FIG. 8 is a side view of a first modified embodiment of the vehicle bumper protector shown in FIG. 1.
Figure 9:
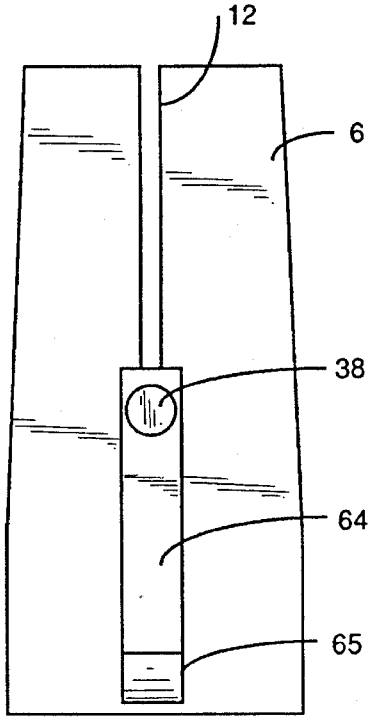
FIG. 9 is a front view of the vehicle bumper protector shown FIG. 8.
Figure 10:
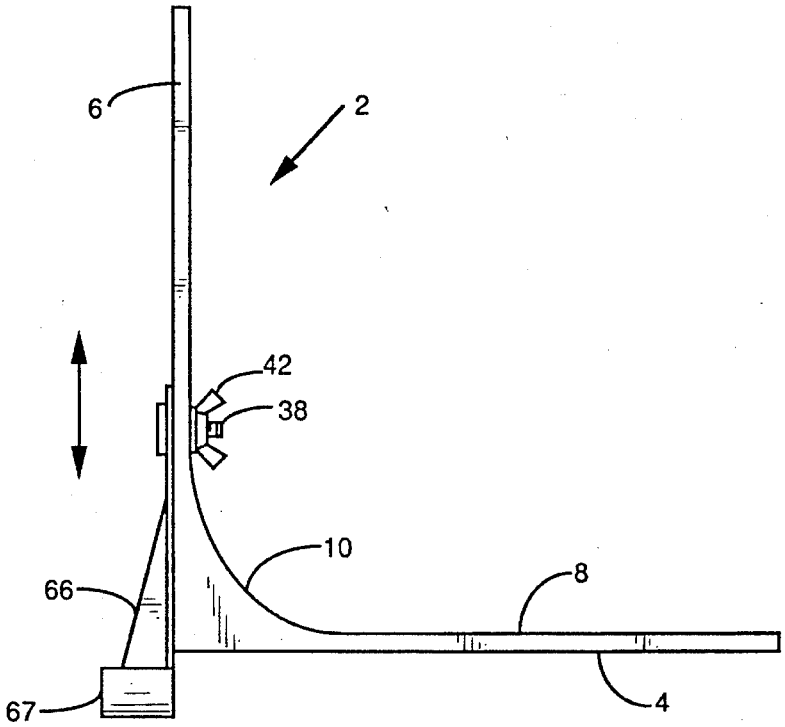
FIG. 10 is a side view of a second modified embodiment of the vehicle bumper shown in FIG. 1.
Figure 11:
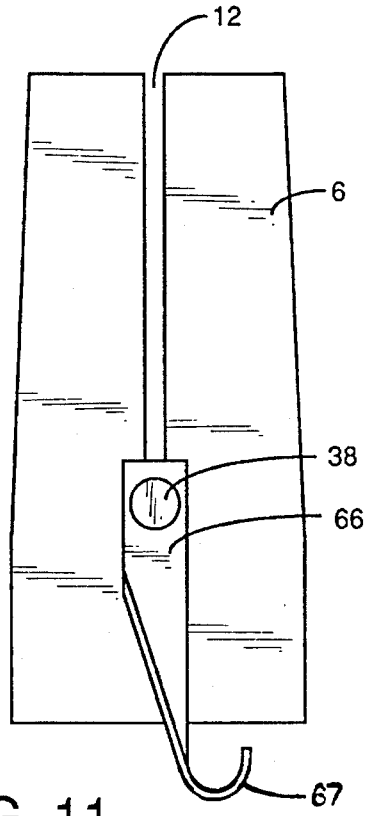
FIG. 11 is a front view of the vehicle bumper protector shown in FIG. 10.

Some vehicles, particularly minivans and station wagons, may not have a suitable trunk wall which can be straddled by the inverted U-shaped trunk support bracket. It may, nevertheless, be desirable to use the footrest 4 portion of the present invention on such a vehicle. In order to accomplish this goal, the present invention includes, as shown in FIGS. 8–11, two arrangements in which the U-shaped bracket is removed from the base member 2 and replaced with a metal J-shaped hook member. The J-shaped hook member is attached to the back plate 6 of the base 2, through the first adjustment slot 12, by a similar wing nut fastener. The arrangement shown in FIGS. 8 and 9 shows a first J-shaped hook 64 with a hook member 65 oriented away from a rear or inner surface of the back plate 6. FIGS. 10 and 11 show a second J-shaped hook 66 which has a hook member 67 oriented toward one side, or the other, of the back plate 6. These two different arrangements of the J-shaped hook permit the footrest 4 to be hooked in and attached to a variety of trunk closure brackets, clips or the like. The J-shaped hooks are positioned along the back plate 6 to a desired height and may be positioned with the hook member above the footrest 4 (as shown in FIGS. 8 and 9) or with the hook member below the footrest 4 (as shown in FIGS. 10 and 11).

While the footrest may not contact directly the upper surface of a vehicle bumper, nevertheless, a footrest is provided on a vehicle and away from the vehicle bumper. It is expected that this invention would be sold in a kit form which includes the base 2, the inverted U-shaped trunk support brackets 16 and 22 and each of the J-shaped hooks 64 and 66 shown in FIGS. 8–11. This will provide a golfer with the opportunity to employ the present invention on typical vehicles with a rear trunk wall, as well as on other vehicles not including a rear trunk wall.

Having described above the presently preferred embodiments of the present invention, it is to be understood that the invention may be otherwise embodied within the scope of the appended claims.

I claim:

1. A vehicle bumper protector for golf spikes comprising an L-shaped base including a footrest connected to an outer surface of a vertical back plate, an inverted U-shaped trunk support bracket including first and second right angle L-shaped members connected together, with a horizontal leg of said first L-shaped member located above, abutting and connected to a horizontal leg of said second L-shaped member, with an inner surface of said back plate abutting and connected to an outer surface of a vertical leg of said first L-shaped member, with the horizontal legs of said L-shaped members forming a horizontal brace of said trunk support bracket, with the vertical leg of said first L-shaped member forming an outer vertical leg of said trunk support bracket, and with a vertical leg of said second L-shaped member forming an inner vertical leg of said trunk support bracket, with the inner and outer vertical legs of said trunk support bracket spaced from and parallel to each other, wherein said back plate includes an elongated first adjustment slot therethrough and extending substantially vertically therealong, and further including a first releasable fastener passing through the vertical leg of said first L-shaped member and through said first adjustment slot, with said first releasable fastener connecting said back plate to the vertical leg of said first L-shaped member and, along with said first adjustment slot, permitting the vertical position of said footrest to be adjusted along said trunk support bracket, wherein the horizontal leg of the first L-shaped member includes an elongated second adjustment slot therethrough and extending substantially horizontal and perpendicular to said first adjustment slot, and further including a second releasable fastener passing through the horizontal leg of the second L-shaped member and through said second adjustment slot, with said second releasable fastener connecting together the horizontal legs of said L-shaped members and, along with said second adjustment slot, permitting the width of said trunk support bracket between said inner and outer vertical legs to be adjusted, with the width of said trunk support bracket adjusted to straddle a rear wall of a vehicle trunk and with the vertical position of the footrest adjusted to allow a lower surface of said footrest to contact an upper surface of a vehicle bumper when the horizontal brace of said trunk support bracket contacts an upper surface of the rear wall of the vehicle trunk, with said vehicle bumper protector further including a first raised guide ridge spaced from and extending parallel to said first adjustment slot and located on the outer surface of the vertical leg of said first L-shaped member, further including an elongated first guide groove complementary to said first guide ridge, spaced from and extending parallel to said first adjustment slot and located in the inner surface of said back plate, with said first guide ridge fitting in and slideable along said first guide groove when said back plate is connected to the vertical leg of said first L-shaped member, further including a second raised guide ridge spaced from and extending parallel to said second adjustment slot and located on an outer surface of the horizontal leg of said second L-shaped member, and further including an elongated second guide groove complementary to said second guide ridge, spaced from and extending parallel to said second adjustment slot and located in the inner surface of the horizontal leg of said first L-shaped member, with the second guide ridge fitting in and slideable along said second guide groove when said L-shaped members are connected together, wherein said first releasable fastener has a head which is recessed within and does not protrude above an outer surface of the vertical leg of said first L-shaped member and a releasable nut means adjacent the outer surface of the vertical back plate, and wherein said second releasable fastener has a head which is recessed within and does not protrude above an inner surface of the horizontal leg of said second L-shaped member and a releasable nut means adjacent the outer surface of the horizontal leg of said first L-shaped member.

2. The vehicle bumper protector for golf spikes of claim 1 wherein said first and second releasable fasteners are each wing nut fasteners.

3. The vehicle bumper protector for golf spikes of claim 1 wherein said footrest slopes downward as it extends outwardly from said back plate.

4. The vehicle bumper protector for golf spikes of claim 1 wherein said base, said first L-shaped member, said second L-shaped member, said first releasable fastener and said second releasable fastener are all formed of a plastic material.

* * * * *